US006363724B1

(12) United States Patent
Bechtel et al.

(10) Patent No.: US 6,363,724 B1
(45) Date of Patent: Apr. 2, 2002

(54) GAS ONLY NOZZLE FUEL TIP

(75) Inventors: William Theodore Bechtel, Scotia; David Orus Fitts, Ballston Spa; Guy Wayne DeLeonardo, Glenville, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/652,176

(22) Filed: Aug. 31, 2000

(51) Int. Cl.[7] ..... F02C 1/00

(52) U.S. Cl. ..... 60/737; 60/740; 239/418; 239/424; 239/424.5

(58) Field of Search ..... 239/418, 424, 239/424.5; 60/39.094, 737, 740, 742

(56) References Cited

U.S. PATENT DOCUMENTS

| | | | | |
|---|---|---|---|---|
| 2,801,134 A | | 7/1957 | Neugebaur | |
| 3,088,279 A | | 5/1963 | Diedrich | |
| 3,682,390 A | | 8/1972 | Cheshire | |
| 4,141,213 A | | 2/1979 | Ross | |
| 4,589,260 A | | 5/1986 | Krockow | |
| 5,156,002 A | | 10/1992 | Mowill | |
| 5,161,379 A | * | 11/1992 | Jones | 60/740 |
| 5,211,004 A | | 5/1993 | Black | |
| 5,235,814 A | | 8/1993 | Leonard | |
| 5,259,184 A | | 11/1993 | Borkowicz | |
| 5,274,995 A | | 1/1994 | Horner | |
| 5,288,021 A | * | 2/1994 | Sood | 239/132.5 |
| 5,351,477 A | | 10/1994 | Joshi | |
| 5,361,586 A | | 11/1994 | McWhirter | |
| 5,404,711 A | | 4/1995 | Rajput | |
| 5,450,725 A | | 9/1995 | Takahara | |
| 5,451,160 A | | 9/1995 | Becker | |
| 5,481,866 A | | 1/1996 | Mowill | |
| 5,572,862 A | | 11/1996 | Mowill | |
| 5,628,182 A | | 5/1997 | Mowill | |
| 5,636,510 A | | 6/1997 | Beer | |
| 5,657,632 A | | 8/1997 | Foss | |
| 5,794,449 A | | 8/1998 | Razdan | |
| 5,816,049 A | | 10/1998 | Joshi | |
| 5,833,141 A | * | 11/1998 | Bechtel | 239/406 |

FOREIGN PATENT DOCUMENTS

| | | |
|---|---|---|
| DE | 818 072 | 10/1951 |
| DE | 1 215 443 | 4/1966 |
| GB | 1 444 673 | 8/1976 |
| WO | WO 98 11383 | 3/1998 |

OTHER PUBLICATIONS

U.S. application No. 09/021,081 of TUTHILL et al; copy of claims as pending.

"39th GE Turbine State–of–the–Art Technology Seminar", Tab 1,""F" Technology—the First Half–Million Operating Hours", H.E. Miller.

"39th GE Turbine State–of–the–Art Technology Seminar", Tab 2, "GE Heavy–Duty Gas Turbine Performance Characteristics", F. J. Brooks.

"39th GE Turbine State–of–the–Art Technology Seminar", Tab 3, "9EC 50Hz 170–MW Class Gas Turbine", A. S. Arrao.

"39th GE Turbine State–of–the–Art Technology Seminar", Tab 4, "MWS6001FA—An Advanced–Technology 70–MW Class 50/60 Hz Gas Turbine", Ramachandran et al.

(List continued on next page.)

*Primary Examiner*—Timothy S. Thorpe
*Assistant Examiner*—Ehud Gartenberg
(74) *Attorney, Agent, or Firm*—Nixon & Vanderhye PC

(57) ABSTRACT

A diffusion flame nozzle gas tip is provided to convert a dual fuel nozzle to a gas only nozzle. The nozzle tip diverts compressor discharge air from the passage feeding the diffusion nozzle air swirl vanes to a region vacated by removal of the dual fuel components, so that the diverted compressor discharge air can flow to and through effusion holes in the end cap plate of the nozzle tip. In a preferred embodiment, the nozzle gas tip defines a cavity for receiving the compressor discharge air from a peripheral passage of the nozzle for flow through the effusion openings defined in the end cap plate.

9 Claims, 2 Drawing Sheets

OTHER PUBLICATIONS

"39th GE Turbine State–of–the–Art Technology Seminar", Tab 5, "Turbomachinery Technology Advances at Nuovo Pignone", Benvenuti et al.
"39th GE Turbine State–of–the–Art Technology Seminar", Tab 6, "GE Aeroderivative Gas Turbines—Design and Operating Features", M.W. Horner.
"39th GE Turbine State–of–the–Art Technology Seminar", Tab 7, "Advance Gas Turbine Materials and Coatings", P.W. Schilke.
"39th GE Turbine State–of–the–Art Technology Seminar", Tab 8, "Dry Low $NO_x$ Combustion Systems for GE Heavy–Duty Turbines", L. B. Davis.
"39th GE Turbine State–of–the–Art Technology Seminar", Tab 9, "GE Gas Turbine Combustion Flexibility", M. A. Davi.
"39th GE Turbine State–of–the–Art Technology Seminar", Tab 10, "Gas Fuel Clean–Up System Design Considerations for GE Heavy–Duty Gas Turbines", C. Wilkes.
"39th GE Turbine State–of–the–Art Technology Seminar", Tab 11, "Integrated Control Systems for Advanced Combined Cycles", Chu et al.
"39th GE Turbine State–of–the–Art Technology Seminar", Tab 12, "Power Systems for the 21st Century "H" Gas Turbine Combined Cycles", Paul et al.
"39th GE Turbine State–of–the–Art Technology Seminar", Tab 13, "Clean Coal and Heavy Oil Technologies for Gas Turbines", D. M. Todd.
"39th GE Turbine State–of–the–Art Technology Seminar", Tab 14, "Gas Turbine Conversions, Modifications and Uprates Technology", Stuck et al.
"39th GE Turbine State–of–the–Art Technology Seminar", Tab 15, "Performance and Reliability Improvements for Heavy–Duty Gas Turbines,"J. R. Johnston.
"39th GE Turbine State–of–the–Art Technology Seminar", Tab 16, "Gas Turbine Repair Technology", Crimi et al.
"39th GE Turbine State–of–the–Art Technology Seminar", Tab 17, "Heavy Duty Turbine Operating & Maintenance Considerations", R. F. Hoeft.
"39th GE Turbine State–of–the–Art Technology Seminar", Tab 18, "Gas Turbine Performance Monitoring and Testing", Schmitt et al.
"39th GE Turbine State–of–the–Art Technology Seminar", Tab 19, "Monitoring Service Delivery System and Diagnostics", Madej et al.
"39th GE Turbine State–of–the–Art Technology Seminar", Tab 20, "Steam Turbines for Large Power Applications", Reinker et al.
"39th GE Turbine State–of–the–Art Technology Seminar", Tab 21, "Steam Turbines for Ultrasupercritical Power Plants", Retzlaff et al.
"39th GE Turbine State–of–the–Art Technology Seminar", Tab 22, "Steam Turbine Sustained Efficiency", P. Schofield.
"39th GE Turbine State–of–the–Art Technology Seminar", Tab 23, "Recent Advances in Steam Turbines for Industrial and Cogeneration Applications", Leger et al.
"39th GE Turbine State–of–the–Art Technology Seminar", Tab 24, "Mechanical Drive Steam Turbines", D. R. Leger.
"39th GE Turbine State–of–the–Art Technology Seminar", Tab 25, "Steam Turbines for STAG™ Combined—Cycle Power Systems", M. Boss.
"39th GE Turbine State–of–the–Art Technology Seminar", Tab 26, "Cogeneration Application Considerations", Fisk et al.
"39th GE Turbine State–of–the–Art Technology Seminar", Tab 27, "Performance and Economic Considerations of Repowering Steam Power Plants", Stoll et al.
"39th GE Turbine State–of–the–Art Technology Seminar", Tab 28, "High–Power–Density™ Steam Turbine Design Evolution", J. H. Moore.
"39th GE Turbine State–of–the–Art Technology Seminar", Tab 29, "Advances in Steam Path Technologies", Cofer, IV, et al.
"39th GE Turbine State–of–the–Art Technology Seminar", Tab 30, "Upgradable Opportunities for Steam Turbines", D. R. Dreier, Jr.
"39th GE Turbine State–of–the–Art Technology Seminar", Tab 31, "Uprate Options for Industrial Turbines", R. C. Beck.
"39th GE Turbine State–of–the–Art Technology Seminar", Tab 32, "Thermal Performance Evaluation and Assessment of Steam Turbine Units", P. Albert.
"39th GE Turbine State–of–the–Art Technology Seminar", Tab 33, "Advances in Welding Repair Technology" J. F. Nolan.
"39th GE Turbine State–of–the–Art Technology Seminar", Tab 34, "Operation and Maintenance Strategies to Enhance Plant Profitability", MacGillivray et al.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al.
"39th GE Turbine State–of–the–Art Technology Seminar", Tab 37, "GE Combined Cycle Product Line and Performance", Chase, et al.
"39th GE Turbine State–of–the–Art Technology Seminar", Tab 38, "GE Combined Cycle Experience", Maslak et al.
"39th GE Turbine State–of–the–Art Technology Seminar", Tab 39, "Single–Shaft Combined Cycle Power Generation Systems", Tomlinson et al.
"Advanced Turbine System Program—Conceptual Design and Product Development", Annual Report, Sep. 1, 1994—Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993—Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.

"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176–11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3.
"Proceedings of the Advanced Turbine Systems Annual Program Review Meeting", vol. I, "H Gas Turbine Combined Cycle", J. Corman, p. 14.
"Proceedings of the Advanced Turbine Systems Annual Program Review Meeting", vol. I, "Overview of Westinghouse's Advanced Turbine Systems Program", Bannister et al., p. 22.
"Proceedings of the Advanced Turbine Systems Annual Program Review Meeting", vol. I, "Allison Engine ATS Program Technical Review", D. Mukavetz, p. 31.
"Proceedings of the Advanced Turbine Systems Annual Program Review Meeting", vol. I, "Advanced Turbine Systems Program Industrial System Concept Development", S. Gates, p. 43.
"Proceedings of the Advanced Turbine Systems Annual Program Review Meeting", vol. I, "Advanced Turbine System Program Phase 2 Cycle Selection", Latcovich, Jr., p. 64.
"Proceedings of the Advanced Turbine Systems Annual Program Review Meeting", vol. I, "General Electric ATS Program Technical Review Phase 2 Activities", Chance et al., p. 70.
"Proceedings of the Advanced Turbine Systems Annual Program Review Meeting", vol. I, "Technical Review of Westinghouse's Advanced Turbine Systems Program", Diakunchak et al., p. 75.
"Proceedings of the Advanced Turbine Systems Annual Program Review Meeting", vol. I, "Advanced Combustion Turbines and Cycles: An EPRI Perspective", Touchton et al., p. 87.
"Proceedings of the Advanced Turbine Systems Annual Program Review Meeting", vol. I, "Advanced Turbine Systems Annual Program Review", William E. Koop, p. 89.
"Proceedings of the Advanced Turbine Systems Annual Program Review Meeting", vol. I, "The AGTSR Consortium: An Update", Fant et al., p. 93.
"Proceedings of the Advanced Turbine Systems Annual Program Review Meeting", vol. I, "Overview of Allison/AGTSR Interactions", Sy A. Ali, p. 103.
"Proceedings of the Advanced Turbine Systems Annual Program Review Meeting", vol. I, "Design Factors for Stable Lean Premix Combustion", Richards et al., p. 107.
"Proceedings of the Advanced Turbine Systems Annual Program Review Meeting", vol. I, "Ceramic Stationary as Turbine", M. van Roode, p. 114.
"Proceedings of the Advanced Turbine Systems Annual Program Review Meeting", vol. I, "DOE/Allison Ceramic Vane Effort", Wenglarz et al., p. 148.
"Proceedings of the Advanced Turbine Systems Annual Program Review Meeting", vol. I, "Materials/Manufacturing Element of the Advanced Turbine Systems Program", Karnitz et al., p. 152.
"Proceedings of the Advanced Turbine Systems Annual Program Review Meeting", vol. I, "Land–Based Turbine Casting Initiative", Mueller et al., p. 161.
"Proceedings of the Advanced Turbine Systems Annual Program Review Meeting", vol. I, "Pratt & Whitney Thermal Barrier Coatings", Bornstein et al., p. 182.
"Proceedings of the Advanced Turbine Systems Annual Program Review Meeting", vol. I, "Westinhouse Thermal Barrier Coatings", Goedjen et al., p. 194.
"Proceedings of the Advanced Turbine Systems Annual Program Review Meeting", vol. I, "High Performance Steam Development", Duffy et al., p. 200.
"Proceedings of the Advanced Turbine Systems Annual Program Review Meeting", vol. II, "Lean Premixed Combustion Stabilized by Radiation Feedback and heterogeneous Catalysis", Dibble et al., p. 221.

"Proceedings of the Advanced Turbine Systems Annual Program Review Meeting", vol. II, Rayleigh/Raman/LIF Measurements in a Turbulent Lean Premixed Combustor, Nandula et al. p. 233.

"Proceedings of the Advanced Turbine Systems Annual Program Review Meeting", vol. II, "Lean Premixed Flames for Low $No_x$ Combustors", Sojka et al., p. 249.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276.

"Proceedings of the Advanced Turbine Systems Annual Program Review Meeting", vol. II, "Advanced Turbine Cooling, Heat Transfer, and Aerodynamic Studies", Han et al., p. 281.

"Proceedings of the Advanced Turbine Systems Annual Program Review Meeting", vol. II, "Life Prediction of Advanced Materials for Gas Turbine Application", Zamrik et al., p. 310.

"Proceedings of the Advanced Turbine Systems Annual Program Review Meeting", vol. II, "Advanced Combustion Technologies for Gas Turbine Power Plants", Vandsburger et al., p. 328.

"Proceedings of the Advanced Turbine Systems Annual Program Review Meeting", vol. II, "Combustion Modeling in Advanced Gas Turbine Systems", Smoot et al., p. 353.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371.

"Proceedings of the Advanced Turbine Systems Annual Program Review Meeting", vol. II, "Rotational Effects on Turbine Blade Cooling", Govatzidakia et al., p. 391.

"Proceedings of the Advanced Turbine Systems Annual Program Review Meeting", vol. II, "Manifold Methods for Methane Combustion", Yang et al., p. 393.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410.

"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415.

"Proceedings of the Advanced Turbine Systems Annual Program Review Meeting", vol. II, "Experimental and Computational Studies of Film Cooling With Compound Angle Injection", Goldstein et al., p. 423.

"Proceedings of the Advanced Turbine Systems Annual Program Review Meeting", vol. II, "Compatibility of Gas Turbine Materials with Steam Cooling", Desai et al., p. 452.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465.

"Proceedings of the Advanced Turbine Systems Annual Program Review Meeting", vol. II, Effects of Geometry on Slot–Jet Film Cooling Performance, Hyams et al., p. 474.

"Proceedings of the Advanced Turbine Systems Annual Program Review Meeting", vol. II, "Steam as Turbine Blade Coolant: Experimental Data Generation", Wilmsen et al., p. 497.

"Proceedings of the Advanced Turbine Systems Annual Program Review Meeting", vol. II, "Combustion Chemical Vapor Deposited Coatgings for Thermal Barrier Coating Systems", Hampikian et al., p. 506.

"Proceedings of the Advanced Turbine Systems Annual Program Review Meeting", vol. II, "Premixed Burner Experiments: Geometry, Mixing, and Flame Structure Issues", Gupta et al., p. 516.

"Proceedings of the Advanced Turbine Systems Annual Program Review Meeting", vol. II, "Intercooler Flow Path for Gas Turbines: CFD Design and Experiments", Agrawal et al., p. 529.

"Proceedings of the Advanced Turbine Systems Annual Program Review Meeting", vol. II, "Bond Strength and Stress Measurements in Thermal Barrier Coatings", Gell et al., p. 539.

"Proceedings of the Advanced Turbine Systems Annual Program Review Meeting", vol. II, "Active Control of Combustion Instabilities in Low $NO_x$ Gas Turbines", Zinn et al., p. 550.

"Proceedings of the Advanced Turbine Systems Annual Program Review Meeting", vol. II, "Combustion Instability Modeling and Analysis", Santoro et al., p. 552.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560.

"Proceedings of the Advanced Turbine Systems Annual Program Review Meeting", vol. II, "Heat Pipe Turbine Vane Cooling", Langston et al., p. 566.

"Proceedings of the Advanced Turbine Systems Annual Program Review Meeting", vol. II, "Improved Modeling Techniques for Turbomachinery Flow Fields", Lakshminarayana et al., p. 573.

"Proceedings of the Advanced Turbine Systems Annual Program Review Meeting", vol. II, "Advanced 3D Inverse Method for Designing Turbomachine Blades", T. Dang, p. 582.

"Proceedings of the Advanced Turbine Systems Annual Program Review Meeting", "ATS and the Industries of the Future", Denise Swink, p. 1.

"Proceedings of the Advanced Turbine Systems Annual Program Review Meeting", "Gas Turbine Association Agenda", William H. Day, p. 3.

"Proceedings of the Advanced Turbine Systems Annual Program Review Meeting", "Power Needs in the Chemical Industry", Keith Davidson, p. 17.

"Proceedings of the Advanced Turbine Systems Annual Program Review Meeting", "Advanced Turbine Systems Program Overview", David Esbeck, p. 27.

"Proceedings of the Advanced Turbine Systems Annual Program Review Meeting", "Westinghouse's Advanced Turbine Systems Program", Gerard McQuiggan, p. 35.

"Proceedings of the Advanced Turbine Systems Annual Program Review Meeting", "Overview of GE's H Gas Turbine Combined Cycle", Cook et al., p. 49.

"Proceedings of the Advanced Turbine Systems Annual Program Review Meeting", "Allison Advanced Simple Cycle Gas Turbine System", William D. Weisbrod, p. 73.

"Proceedings of the Advanced Turbine Systems Annual Program Review Meeting", "The AGTSR Industry–University Consortium", Lawrence P. Golan, p. 95.

"Proceedings of the Advanced Turbine Systems Annual Program Review Meeting", "$NO_x$ and CO Emissions Models for Gas–Fired Lean–Premixed Combustion Turbines", A. Mellor, p. 111.
"Proceedings of the Advanced Turbine Systems Annual Program Review Meeting", "Methodologies for Active Mixing and Combustion Control", Uri Vandsburger, p. 123.
"Proceedings of the Advanced Turbine Systems Annual Program Review Meeting", "Combustion Modeling in Advanced Gas Turbine Systems", Paul O. Hedman, p. 157.
"Proceedings of the Advanced Turbine Systems Annual Program Review Meeting", "Manifold Methods for Methane Combustion", Stephen B. Pope, p. 181.
"Proceedings of the Advanced Turbine Systems Annual Program Review Meeting", "The Role of Reactant Unmixedness, Strain Rate, and Length Scale on Premixed Combustor Performance", Scott Samuelsen, p. 189.
"Proceedings of the Advanced Turbine Systems Annual Program Review Meeting", "Effect of Swirl and Momentum Distribution on Temperature Distribution in Premixed Flames", Ashwani K. Gupta, p. 211.
"Proceedings of the Advanced Turbine Systems Annual Program Review Meeting", "Combustion Instability Studies Application ot Land–Based Gas Turbine Combustors", Robert J. Santoro, p. 233.
"Proceedings of the Advanced Turbine Systems Annual Program Review Meeting", Active Control of Combustion Instabilities in Low $NO_x$ Turbines, Ben T. Zinn, p. 253.
"Proceedings of the Advanced Turbine Systems Annual Program Review Meeting", "Life Prediction of Advanced Materials for Gas Turbine Application," Sam Y. Zamrik, p. 265.
"Proceedings of the Advanced Turbine Systems Annual Program Review Meeting", "Combustion Chemical Vapor Deposited Coatings for Thermal Barrier Coating Systems", W. Brent Carter, p. 275.
"Proceedings of the Advanced Turbine Systems Annual Program Review Meeting", "Compatibility of Gas Turbine Materials with Steam Cooling", Vimal Desai, p. 291.
"Proceedings of the Advanced Turbine Systems Annual Program Review Meeting", "Bond Strength and Stress Measurements in Thermal Barrier Coatings", Maurice Gell, p. 315.
"Proceedings of the Advanced Turbine Systems Annual Program Review Meeting", "Advanced Multistage Turbine Blade Aerodynamics, Performance, Cooling and Heat Transfer", Sanford Fleeter, p. 335.
"Proceedings of the Advanced Turbine Systems Annual Program Review Meeting", "Flow Characteristics of an Intercooler System for Power Generating Gas Turbines", Ajay K. Agrawal, p. 357.
"Proceedings of the Advanced Turbine Systems Annual Program Review Meeting", "Inmproved Modeling Techniques for Turbomachinery Flow Fields", B. Lakshiminarayana, p. 371.
"Proceedings of the Advanced Turbine Systems Annual Program Review Meeting", "Development of an Advanced 3d & Viscous Aerodynamic Design Method for Turbomachine Components in Utility and Industrial Gas Turbine Applications", Tong Q. Dang, p. 393.
"Proceedings of the Advanced Turbine Systems Annual Program Review Meeting", "Advanced Turbine Cooling, Heat Transfer, and Aerodynamic Studies", Je–Chin Han, p. 407.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427.
"Proceedings of the Advanced Turbine Systems Annual Program Review Meeting", "Experimental and Computational Studies of Film Cooling with Compound Angle Injection", R. Goldstein, p. 447.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461.
"Proceedings of the Advanced Turbine Systems Annual Program Review Meeting", "Steam as a Turbine Blade Coolant: External Side Heat Transfer", Abraham Engeda, p. 471.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483.
"Proceedings of the Advanced Turbine Systems Annual Program Review Meeting", "Closed–Loop Mist/Steam Cooling for Advanced Turbine Systems", Ting Wang, p. 499.
"Proceedings of the Advanced Turbine Systems Annual Program Review Meeting", "Heat Pipe Turbine Vane Cooling", Langston et al., p. 513.
"Proceedings of the Advanced Turbine Systems Annual Program Review Meeting", "EPRI's Combustion Turbine Program: Status and Future Directions", Arthur Cohn, p. 535.
"Proceedings of the Advanced Turbine Systems Annual Program Review Meeting", "ATS Materials Support", Michael Karnitz, p. 553.
"Proceedings of the Advanced Turbine Systems Annual Program Review Meeting", "Land Based Turbine Casting Initiative", Boyd A. Mueller, p. 577.
"Proceedings of the Advanced Turbine Systems Annual Program Review Meeting", "Turbine Airfoil Manufacturing Technology", Charles S. Kortovich, p. 593.
"Proceedings of the Advanced Turbine Systems Annual Program Review Meeting", "Hot Corrosion Testing of TBS's", Norman Bornstein, p. 623.
"Proceedings of the Advanced Turbine Systems Annual Program Review Meeting", "Ceramic Stationary Gas Turbine", Mark van Roode, p. 633.
"Proceedings of the Advanced Turbine Systems Annual Program Review Meeting", "Western European Status of Ceramics for Gas Turbines", Tibor Bornemisza, p. 659.
"Proceedings of the Advanced Turbine Systems Annual Program Review Meeting", "Status of Ceramic Gas Turbines in Russia", Mark van Roode, p. 671.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda.
"Testing Program Results Validate GE's H Gas Turbine—High Efficiency, Low Cost of Electricity and Low Emissions", Slide Presentation—working draft.
"The Next Step In H . . . For Low Cost Per kW–Hour Power Generation", LP–1 PGE '98.

"Utility Advanced Turbine System (ATS) Technology Readiness Testing and Pre–Commercialization Demonstration", Document #486040, Oct. 1– Dec. 31, 1996, Publication Date, Jun. 1, 1997, Report Nos.: DOE/MC/31176–5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176–10.
"Utility Advanced Turbine System (ATS) Technology Readiness Testing and Pre–Commercial Demonstration, Phase 3", Document #486029, Oct. 1—Dec. 31, 1995, Publication Date, May 1, 1997, Report Nos.: DOE/MC/31176–5340.
"Utility Advanced Turbine System (ATS) Technology Readiness Testing and Pre–Commercial Demonstration—Phase 3", Document #486132, Apr. 1—Jun. 30, 1976, Publication Date, Dec. 31, 1996, Report Nos.: DOE/MC/31176–5660.
"Utility Advanced Turbine System (ATS) Technology Readiness Testing and Pre–Commercial Demonstration—Phase 3", Document #587906, Jul. 1—Sep. 30, 1995, Publication Date, Dec. 31, 1995, Report Nos.: DOE/MC/31176–5339.
"Utility Advanced Turbine System (ATS) Technology Readiness Testing and Pre–Commercial Demonstration" Document #666277, Apr. 1—Jun. 30, 1997, Publication Date, Dec. 31, 1997, Report Nos.: DOE/MC/31176–8.
"Utility Advanced Turbine System (ATS) Technology Readiness Testing and Pre–Commercialization Demonstration" Jan. 1—Mar. 31, 1996, DOE/MC/31176–5338.
"Utility Advanced Turbine System (ATS) Technology Readiness Testing: Phase 3R", Document #756552, Apr. 1—Jun. 30, 1999, Publication Date, Sep. 1, 1999, Report Nos.: DE–FC21–95MC31176–23.
"Utility Advanced Turbine System (ATS) Technology Readiness Testing.", Document #656823, Jan. 1—Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995 –Sep. 30, 1996.
"Utility Advanced Turbine Systems (ATS) Technology Readiness Testing", Phase 3R, Annual Technical Progress Report, Reporting Period: Oct. 1, 1997—Sep. 30, 1998.
"Utility Advanced Turbine Systems (ATS) Technology Readiness Testing", Document #750405, Oct. 1—Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1—Jun. 29, 1998, Publication Date Oct. 29, 1998, Report Nos. DE–FC21–95MC31176–18.
"Utility Advanced Turbine Systems (ATS) Technology Readiness Testing—Phase 3", Annual Technical Progress Report, Reporting Period: Oct. 1, 1996—Sep. 30, 1997.
"Utility Advanced Turbine Systems (ATS) Technology Readiness Testing and Pre–Commercial Demonstration", Quarterly Report, Jan. 1—Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

GAS ONLY NOZZLE FUEL TIP

This Invention was made with Government support under Contract No. DE-FC21-95MC31176 awarded by the Department of Energy. The Government has certain rights in this invention.

BACKGROUND OF THE INVENTION

The invention relates to a fuel nozzle and more particularly to an end cap plate of a "Dual Fuel" nozzle design that has been configured for gas only use and to an adaptation for cooling the same.

Gas turbines for power generation are generally available with fuel nozzles configured for either "Dual Fuel" or "Gas Only". "Gas Only" refers to operation burning, for example, natural gas and "Dual Fuel" refers to having the capability of operation burning either natural gas or liquid fuel. The dual fuel configuration is generally applied with oil used as a backup fuel, if natural gas is unavailable. The gas only configuration is offered in order to reduce costs as the nozzle parts and all associated equipment required for liquid fuel operation are not supplied. In general, fuel nozzles are designed to have dual fuel capability and the gas only version is a modification to the dual fuel design in which the dual fuel parts, which include the oil, atomizing air and water passages, are removed from the nozzle. The removal of these components exposes a cylindrical, open region along the axial center line of the nozzle to hot combustion gas. An example of a dual fuel nozzle modified to remove the dual (liquid) fuel parts is illustrated in FIG. 1. This nozzle is disclosed in detail in copending application Ser. No. 09/021,081, filed Feb. 10, 1998, the entire disclosure of which is incorporated herein by this reference.

FIG. 1 is a cross-section through the burner assembly. The burner assembly is divided into four regions by function including an inlet flow conditioner 7, an air swirler assembly with natural gas fuel injection (referred to as a nozzle assembly) 2, an annular fuel air mixing passage 3, and a central diffusion flame natural gas fuel swozzle assembly 13.

Air enters the burner from a high pressure plenum 5, which surrounds the entire assembly except the discharge end, which enters the combustor reaction zone 6. Most of the air for combustion enters the premixer via the inlet flow conditioner (IFC) 7. The IFC includes an annular flow passage 8 that is bounded by a solid cylindrical inner wall 9 at the inside diameter, a perforated cylindrical outer wall 10 at the outside diameter, and a perforated end cap 11 at the upstream end. In the center of the flow passage 8 is one or more annular turning vanes 12. Premixer air enters the IFC 7 via the perforations in the end cap 11 and the cylindrical outer wall 10.

At the center of the burner assembly is a conventional diffusion flame fuel nozzle tip 13 having a slotted gas tip 14, which receives combustion air from an annular passage 15 and natural gas fuel through gas holes 16. The body of this fuel nozzle includes a bellows 17 to compensate for differential thermal expansions between this nozzle and the premixer. In the center of this diffusion flame fuel nozzle is a cavity 18, which, as noted above, receives the liquid fuel assembly to provide dual fuel capability. In the dual fuel configuration, during gas fuel operation, the oil, atomizing air and water passages in this region are purged with cool air to block hot gas from entering the passages when not in use. When the nozzle is configured for gas only operation, cavity 18 must be capped at the distal end of the nozzle to block hot combustion gas from entering the center, open region which may result in mechanical damage due to the high temperature. Since the end cap plate is exposed to hot combustion gas, it must be cooled.

In the past, cooling of the end cap plate used to cover the open region at the nozzle tip in a conversion from a dual fuel to a gas only configuration has been accomplished using the gas fuel as the cooling medium. More specifically, because removal of the dual fuel components eliminates the structure that formed the inner wall of the gas fuel passage, a part of the gas fuel can effuse through tiny holes in the end cap plate (not shown in FIG. 1) to cool the same while the bulk of the fuel passes through the normal gas hole injectors 16 which are located between the air swirler vanes. This is a very simplified design for converting from a dual fuel to gas only nozzle. While generally effective, this approach is undesirable in view of the need to maintain low emissions over the gas turbine operating range. Diverting gas fuel for cooling from the desired injection points between the air swirler vanes and injecting that gas at a different location through tiny holes in an end cap plate (not shown in FIG. 1) for cooling reduces the premixing of gas fuel and air which is essential for low emissions performance.

Another possible method for cooling the end cap plate is to use the cooling air supplied from the nozzle purge air system. The nozzle purge air system supplies air cooled so that its temperature does not exceed 750° F. As briefly described above with reference to purging the liquid fuel components during gas fuel operation, this air is generally applied to purging the gas fuel passages when not in use to resist the back-flow of hot combustion gas into the gas passages, manifolds and pipings. The limit of not exceeding an air temperature of 750° F. relates to the possible auto-ignition of gas fuel coming into contact with air exceeding that temperature. Since an end cap plate passage adapted to receive purge air for cooling rather than gas fuel would never have gas fuel present, it would be inefficient to use specially cooled air from the nozzle purge system to cool an end cap plate.

BRIEF SUMMARY OF THE INVENTION

The existing fuel nozzle purge system does not have the capacity to supply the additional amount of air required for cooling the gas only nozzle end cap plate, nor would such a use of that specially cooled air be efficient.

It has been determined, however, that compressor discharge air would be an adequate cooling medium. Thus, a diffusion flame nozzle gas tip has been designed to allow for the use of compressor discharge air to cool the end cap plate. The appropriate amount of compressor discharge air is extracted from annular passage 15 into the central region 18 and is emitted through tiny (effusion) holes in the end cap plate to produce the desired cooling.

Thus, the invention is embodied in a method for cooling the end cap plate of a gas only fuel nozzle in which compressor discharge air is supplied as the cooling medium. The method of the invention advantageously replaces the requirement to use either cooling air from the existing nozzle purge system or gas fuel as the cooling medium. In accordance with an embodiment of the invention, this is accomplished by providing a diffusion flame nozzle gas tip that diverts compressor discharge air from the passage feeding the diffusion nozzle air swirl vanes to the cavity vacated by removal of the dual fuel components so that the diverted compressor discharge air can flow to and through effusion holes in the end cap plate. In a preferred embodiment, the nozzle gas tip defines a cavity for receiving the compressor discharge air from a peripheral passage of the nozzle for flow through the effusion openings defined in the end cap tip.

DETAILED DESCRIPTION OF THE INVENTION

Figure 1:
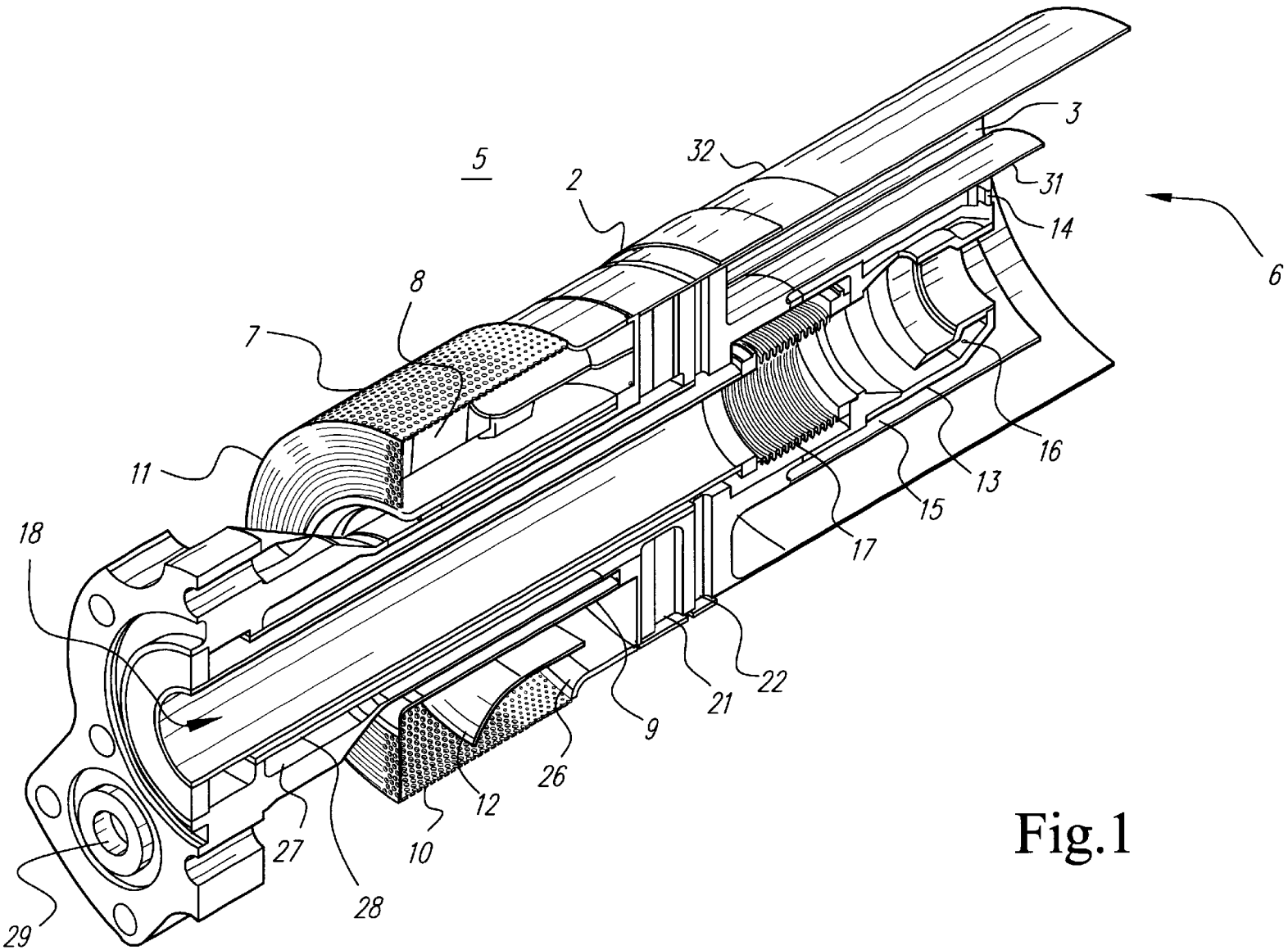
FIG. 1 is an isometric view of a fuel nozzle with the liquid fuel parts removed from the center portion of the nozzle.

As described above, FIG. 1 is an isometric view of a fuel nozzle with the liquid fuel parts removed from the center portion of the nozzle. With the liquid fuel parts of the dual fuel nozzle removed for the gas only configuration, the cavity must be closed at the distal end in order to preclude hot combustion gas from flowing into this region and to direct the gas fuel to and through the gas holes.

Figure 2:
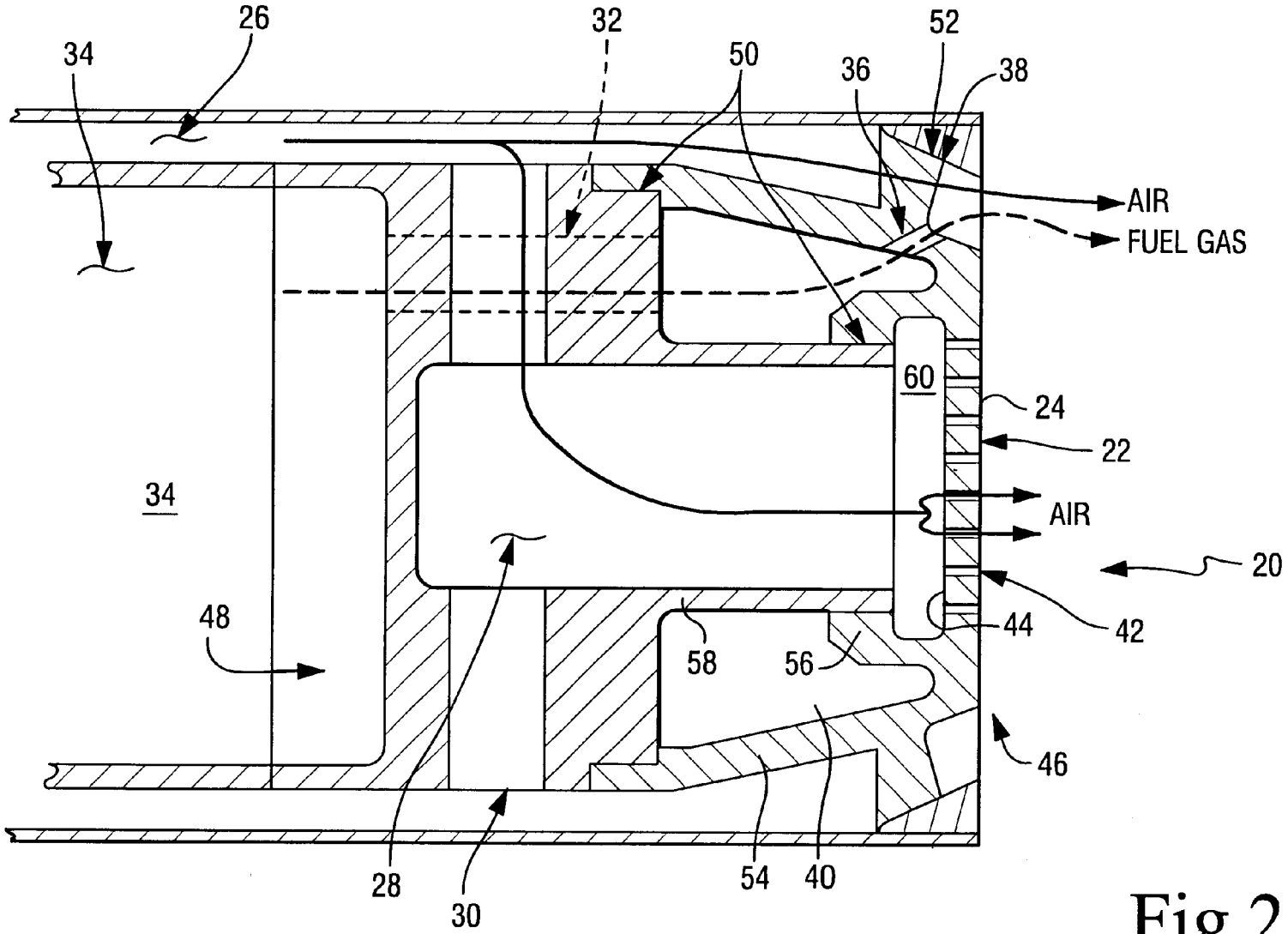
FIG. 2 is a cross-sectional view of a diffusion gas tip for a gas only nozzle that embodies the invention.

With reference to FIG. 2, an embodiment of a diffusion gas tip 20 specifically for the gas only nozzle of the invention is shown. End cap plate 22 which closes the cavity formed by removal of the liquid fuel parts must be cooled because its distal surface 24 is exposed to hot combustion gas. To cool the end cap plate, compressor discharge air is diverted from annular channel 26, which feeds air through the diffusion air swirl vanes, and directed into a cavity 28 defined behind the end cap plate 22. In the illustrated embodiment, four circular, radial holes 30 transfer the compressor discharge air from annular outer passage 26 to inner cavity 28. Moreover, in the illustrated embodiment, these four radial cooling air transfer passages 30 are equally spaced circumferentially of the cavity 28 and are preferably equally spaced between the axial gas fuel passages 32 that transfer gas from the center nozzle cavity 34 to the gas injection holes 36 in the air swirl vanes 38. In the illustrated embodiment, an annular gas plenum 40 receives the gas from gas passages 32 for distribution to gas injection holes 36. The size of passages 30 and their orientation relative to the longitudinal axis of the nozzle may be varied as deemed necessary or desirable to determine the amount of compressor bleed air diverted toward cavity 28, it being understood, however, that the primary limiting factor with respect to cooling air flow would be the effusion openings 42 of the end cap plate 22, which will determine the volume of flow therethrough.

In the central air cavity 28, air received through passages 30 is directed to flow through small effusion holes 42 in the end cap plate 22, thereby cooling not only the proximal surface 44 of the end cap plate 22, but also to enhance the cooling of the entire plate structure. It is to be appreciated that the amount of compressor discharge air diverted for the end cap plate cooling represents only a very small percentage of that passing through the annular passage 26 that feeds the diffusion nozzle air swirl vanes 38.

In the illustrated embodiment, the nozzle tip is comprised of a tip part 46 and a flow diverter part 48. The diverter part 48 is secured to the tip part 46 as by brazed joints shown at 50. The tip part 46 is in turn brazed to the nozzle structure as at 52. The tip part 46 defines the end cap plate 22, the diffusion nozzle swirl vanes 38, an outer peripheral wall 54 of gas plenum 40, and a receiver 56 for receiving a cavity defining wall 58 of the diverter part 48. In the illustrated embodiment, the tip part 46 defines a distal portion 60 of the cavity 27. The flow diverter part 48 defines a remainder of the cavity 28, compressor bleed air diverting passages 30 for diverting air to cavity 28 for cooling the end cap plate 22 and the axial passages 32 for gas fuel flow from the center nozzle cavity 34 to and through the fuel injection holes 36.

As will be appreciated, the above described diffusion gas tip allows for the use of compressor discharge air to cool the end cap plate on the distal tip of the gas only fuel nozzle and replaces the use of either gas fuel or cooled air from the existing nozzle air purge system for this function. Also, the invention advantageously requires modification of only the diffusion tip sub-assembly to convert from a dual fuel to a gas only fuel nozzle design. The impact of this modification for the gas only nozzle would not be expected to substantially alter the gas fuel operational characteristics of the nozzle from the gas only mode of the dual fuel configuration.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle fuel tip for converting a dual fuel nozzle to a gas only nozzle configuration comprising:

an end cap plate structure for capping the liquid fuel assembly cavity of a dual fuel nozzle, said end cap plate structure having a distal surface, a proximal surface, and a plurality of openings defined therethrough for cooling fluid flow, and a cavity defining structure disposed proximal to said proximal surface of said end cap plate for defining an air cavity proximal to and in flow communication with said openings, said cavity defining structure further including a plurality of cooling air passages extending from an outer peripheral surface thereof to said cavity for the flow of cooling air from said outer peripheral surface to said cavity and a plurality of gas fuel passages extending from a proximal end of said cavity defining structure to a distal end of said cavity defining structure, said air cavity and said fuel flow being substantially isolated by said cavity defining structure.

2. A nozzle fuel tip as in claim 1, further comprising a wall disposed peripherally of said cavity defining structure and spaced therefrom to define a gas plenum therebetween for receiving and distributing gas fuel flow flowing thereto through said gas fuel passages.

3. A nozzle fuel tip as in claim 2, further comprising a plurality of gas injection holes defined about a periphery of said end cap plate for directing gas fuel from said gas fuel plenum generally distally.

4. A nozzle fuel tip as in claim 1, composed of a tip part and a diverter part, said tip part comprising said end cap plate and said diverter part comprising said cavity defining structure.

5. A nozzle fuel tip as in claim 4, wherein said tip part and said diverter part are brazed so as to be fixedly secured as an integrated unit.

6. A nozzle fuel tip as in claim 1, wherein there are four said cooling air passages.

7. A nozzle fuel tip as in claim 6, wherein there are four said gas fuel passages, a gas fuel passage being disposed between adjacent said cooling air passages.

8. A nozzle fuel tip as in claim 1, wherein said gas fuel passages extend in a direction generally parallel to a longitudinal axis of said nozzle.

9. A nozzle fuel tip as in claim 1, wherein said cooling air passages are oriented in a direction generally transverse to a longitudinal axis of said nozzle so that said passages each extend generally radially with respect to said longitudinal axis.

* * * * *